US010513386B1

(12) United States Patent
Loseto

(10) Patent No.: US 10,513,386 B1
(45) Date of Patent: Dec. 24, 2019

(54) SURF WAX HANDLING ASSEMBLY

(71) Applicant: Luciano Loseto, Massapequa, NY (US)

(72) Inventor: Luciano Loseto, Massapequa, NY (US)

( * ) Notice: Subject to any disclaimer, the term of this patent is extended or adjusted under 35 U.S.C. 154(b) by 12 days.

(21) Appl. No.: 16/004,364

(22) Filed: Jun. 9, 2018

(51) Int. Cl.

| | |
|---|---|
| ***A45D 40/20*** | (2006.01) |
| ***B65D 83/00*** | (2006.01) |
| ***A63C 11/04*** | (2006.01) |
| *B63B 35/79* | (2006.01) |

(52) U.S. Cl.
CPC ..... *B65D 83/0005* (2013.01); *A63C 11/04* (2013.01); *B63B 35/79* (2013.01)

(58) Field of Classification Search
CPC ..... B65D 83/0005; B63B 35/79; A63C 11/04
USPC ..... 401/88
See application file for complete search history.

(56) References Cited

U.S. PATENT DOCUMENTS

| | | | | |
|---|---|---|---|---|
| 2,379,745 | A | 7/1945 | Pischel et al. | |
| 4,215,947 | A * | 8/1980 | Sparling | A63C 11/04 118/64 |
| 5,150,978 | A | 9/1992 | Stewart et al. | |
| 5,219,238 | A | 6/1993 | Hainbach | |
| 6,821,041 | B1 | 11/2004 | Hallam et al. | |
| 8,448,276 | B2 | 5/2013 | Carroll | |
| 2006/0248792 | A1 | 11/2006 | Huxley | |
| 2008/0086829 | A1 | 4/2008 | Adams | |
| 2008/0193192 | A1 | 8/2008 | Zulian | |
| 2012/0144609 | A1 | 6/2012 | Nakano | |
| 2012/0170964 | A1 | 7/2012 | Bogdanoff | |

FOREIGN PATENT DOCUMENTS

| | | |
|---|---|---|
| WO | WO2008037003 A1 | 4/2008 |

* cited by examiner

*Primary Examiner* — Jennifer C Chiang
(74) *Attorney, Agent, or Firm* — The Law Office of Daniel T. Weglarz, P.C.

(57) ABSTRACT

A surf wax handling assembly having a base member that is an elongated, rigid body having a slanted scraper at one end and a top portion that includes a pressing surface disposed between two opposing raised side edges; a hollow receptacle member that is a rigid container having an open top, an open bottom, and a hollow interior, with the receptacle member configured to selectively engage with the top portion of the base member such that the pressing surface of the base member encloses the open bottom of the receptacle member; and a press member configured to slide into the open top of the receptacle member and through the hollow interior of the receptacle member so as to press individual wax pieces present into the hollow portion away from the open top and against the pressing surface to form a larger piece that can be immediately reused.

20 Claims, 5 Drawing Sheets

Fig. 7
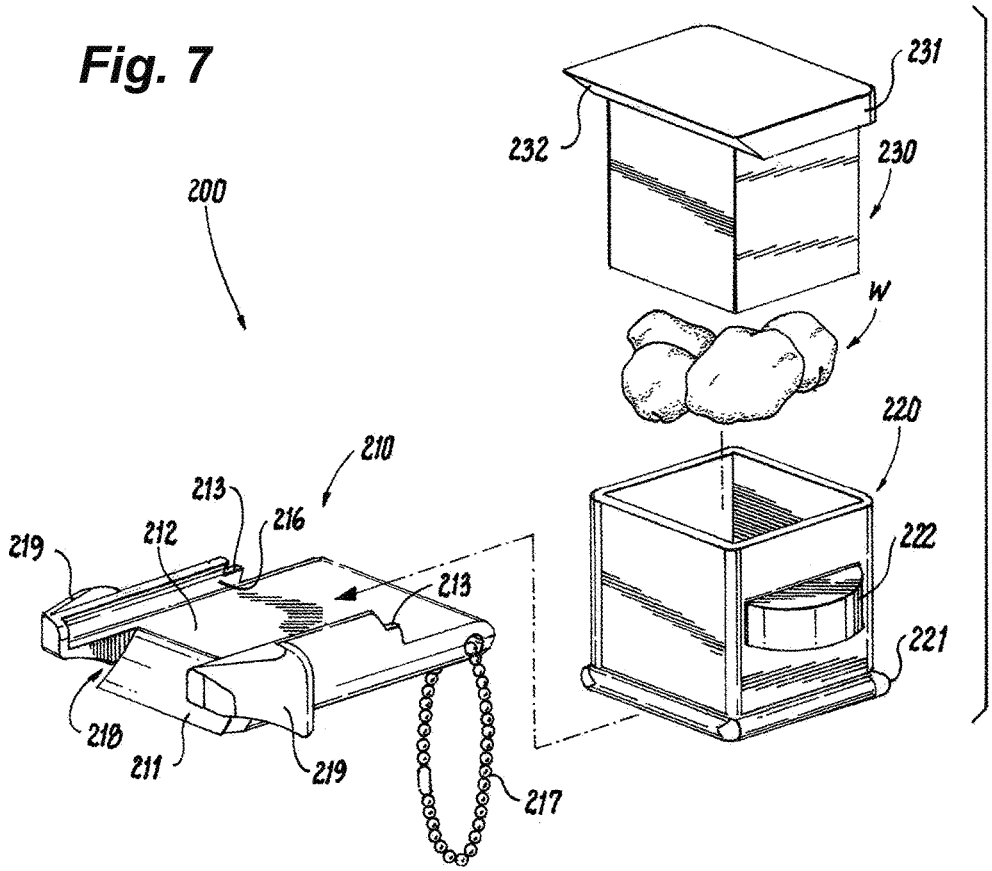
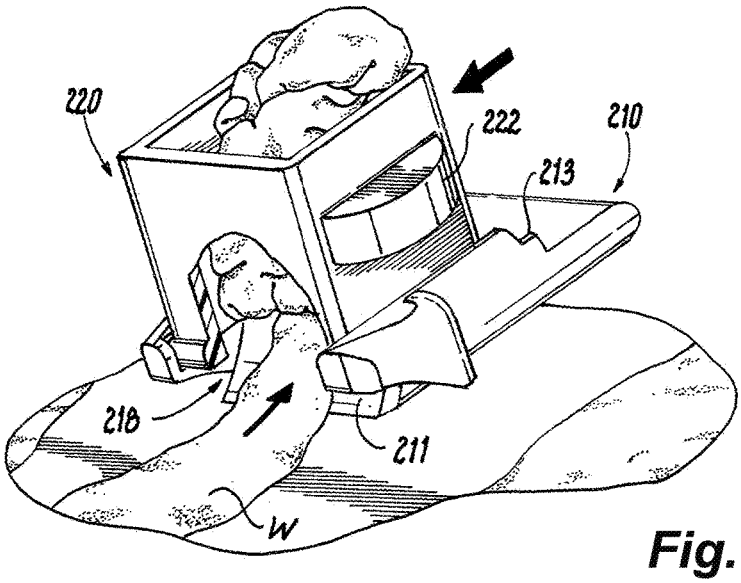
Fig. 8

Fig. 9
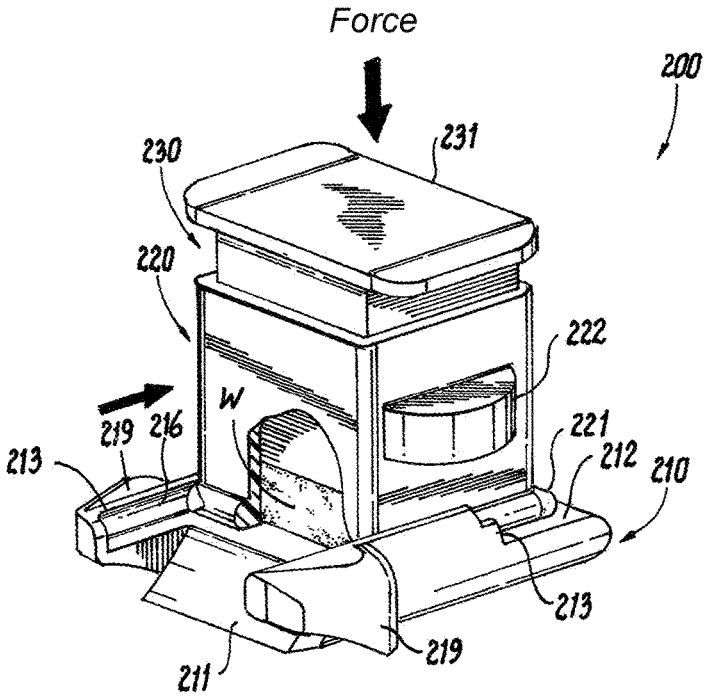
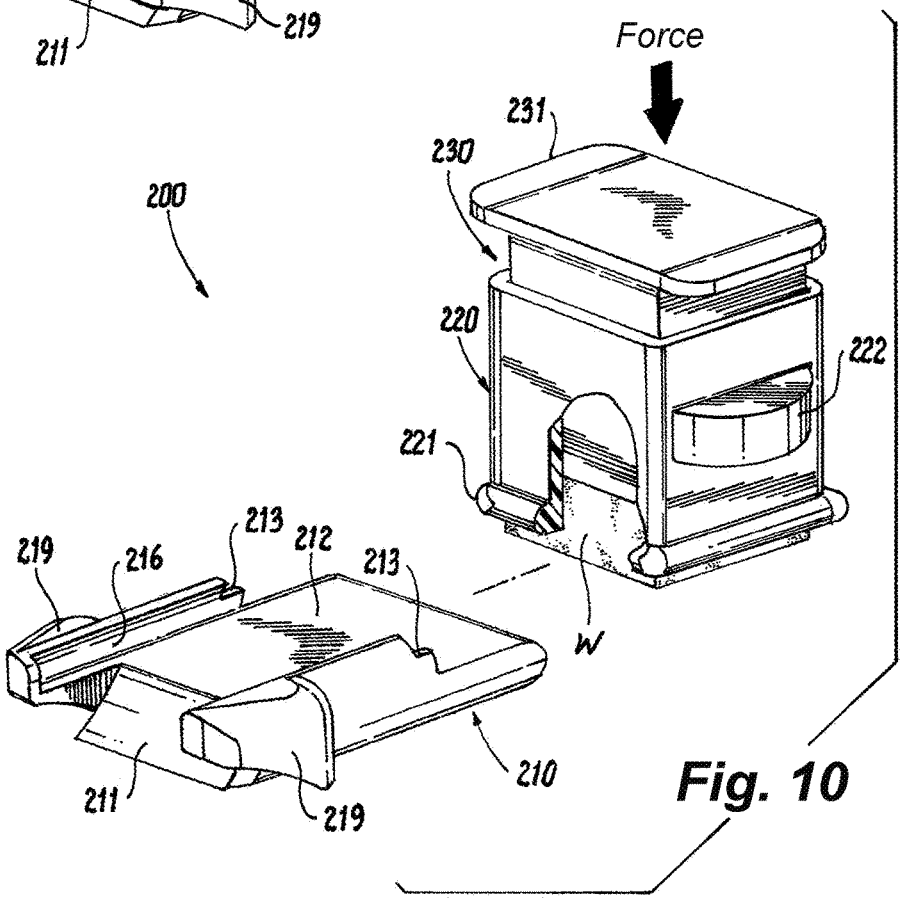
Fig. 10

SURF WAX HANDLING ASSEMBLY

BACKGROUND OF THE INVENTION

Field of the Invention

This invention relates generally to wax handling assemblies and, more particularly, to a composite surf wax handling assembly that provides effective reuse of surfboard wax.

Description of the Prior Art

The use of surf wax (or "surfboard wax") as material to be applied to the deck of a surfboard (or other buoyant platform) to help keep a user positioned on the surfboard from slipping off is well established. Typically, unused surf wax is applied to a surfboard, often from a bar, prior to the use of the surfboard and then removed following use of the surfboard. Such a routine, however, results in a significant amount of wax being wasted as the small pieces of unused surf wax at the end of the bar are usually too small to use and are thus discarded. Moreover, typical wax scrapers do not provide for any convenient mechanism to capture or reuse pieces of wax scraped off of a surfboard and so such scrapings are also typically discarded.

Thus, there remains a need for an assembly that allows a user to conveniently prepare used wax scrapings and other small pieces of wax for reuse as well as capture wax scraped off of a board for reuse.

SUMMARY OF THE INVENTION

A surf wax handling assembly comprising a base member, a hollow receptacle member that slidably engages with the base member, and a press member sized to slidably engage with the receptacle member so as to be able to slide into the hollow portion of the receptacle member. When in operation, the surf wax handling assembly enables the removal and collection of surf wax from a surfboard as well as the convenient processing of the removed wax, and other small pieces of available wax, for immediate reuse.

In this regard, the base member is defined by an elongated, rigid body having a slanted scraper at one end and a top portion that includes a pressing surface disposed between two opposing raised side edges. The receptacle member is defined by a rigid container having an open top, an open bottom, and a hollow interior, with the receptacle member configured to selectively engage with the top portion of the base member such that the pressing surface of the base member encloses the open bottom of the receptacle member. The press member is configured to slide into the open top of the receptacle member and through the hollow interior of the receptacle member so as to move material present in the hollow portion away from the open top.

It is an object of this invention to provide a surf wax handling assembly that allows a user to both capture wax scraped off of a board as well as conveniently prepare used wax scrapings and other small pieces of wax for reuse.

This and other objects will be apparent to one of skill in the art.

BRIEF DESCRIPTION OF THE DRAWINGS

FIG. 7 is a perspective view of a surf wax handling assembly built in accordance with a collection embodiment of the present invention, shown with wax.

FIG. 8 is a perspective view of the receptacle member shown together with the base member of a surf wax handling assembly built in accordance with a collection embodiment of the present invention, shown with a portion of the receptacle member cut away, and shown with the receptacle member in distal position with wax being scraped into the receptacle member.

FIG. 9 is a perspective view of a surf wax handling assembly built in accordance with a collection embodiment of the present invention shown with a portion of the receptacle member cut away, and shown with the receptacle member in a pressing position with the press member being pushed into the receptacle member to press wax.

FIG. 10 is a perspective view of a surf wax handling assembly built in accordance with a collection embodiment of the present invention shown with a portion of the receptacle member cut away, and shown with the press member being pushed into the receptacle member to push wax out of the bottom opening of the receptacle member.

DETAILED DESCRIPTION OF THE INVENTION

Figure 1:
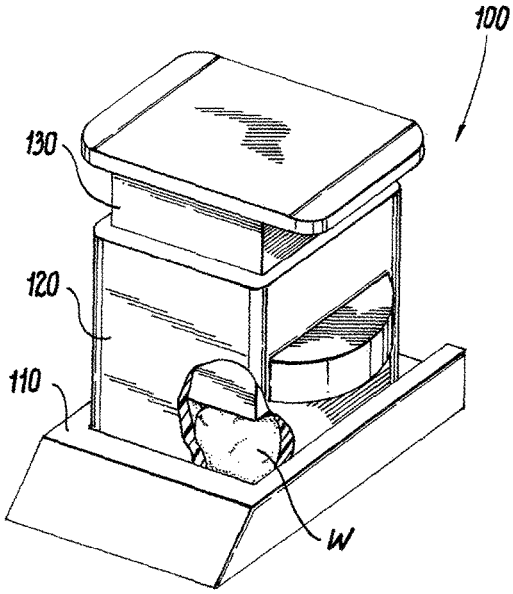
FIG. 1 is a perspective view of a surf wax handling assembly built in accordance with a fin key embodiment of the present invention, shown with a portion of the receptacle member cut away.

The invention described herein provides for a surf wax handling assembly operative to receive small wax pieces, press wax pieces together, and apply pressed wax pieces to a surfboard.

Referring now to the drawings and in particular FIGS. 1, 2, 3, 4, 5, and 6, a fin key embodiment of a surf wax handling assembly 100 for reusing pieces of wax W is shown having a base member 110, a hollow receptacle member 120, and a press member 130. When the surf wax handling assembly 100 is assembled, the receptacle member 120 is structured to slidably engage with the base member 110 and the press member 130 sized to slidably engage with the receptacle member 120.

The base member 110 is defined by an elongated, rigid body having a slanted scraper 111 at one end, a top portion that includes a planar surface 112 disposed between two opposing raised side edges 113, and a bottom portion that includes a depressed surface 114 and a fin key slot 115 (in which a fin key 115*a* can be inserted). In one embodiment, the raised side edges 113 extend longitudinally along the elongated body of the base member 110 and each includes a securing recess 116 therein extending along their respective length.

Figure 2:
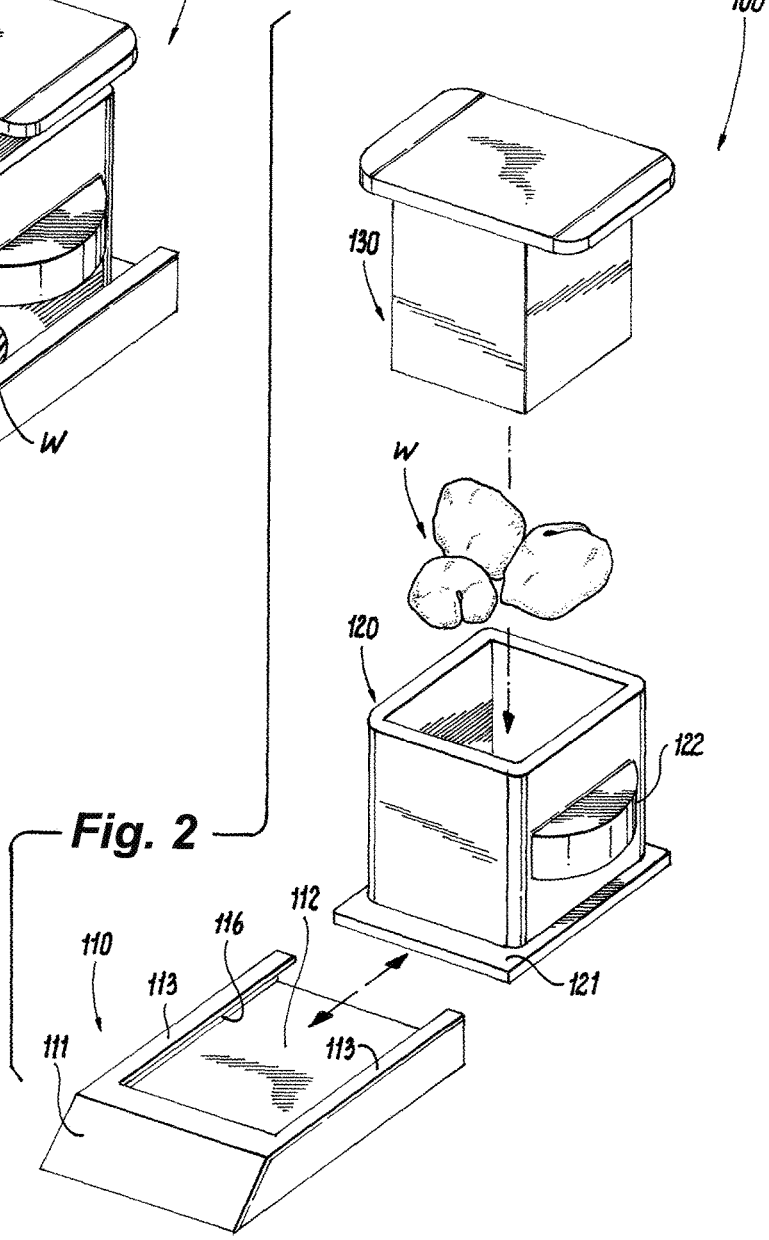
FIG. 2 is a perspective view of a surf wax handling assembly built in accordance with a fin key embodiment of the present invention shown with wax.
Figure 3:
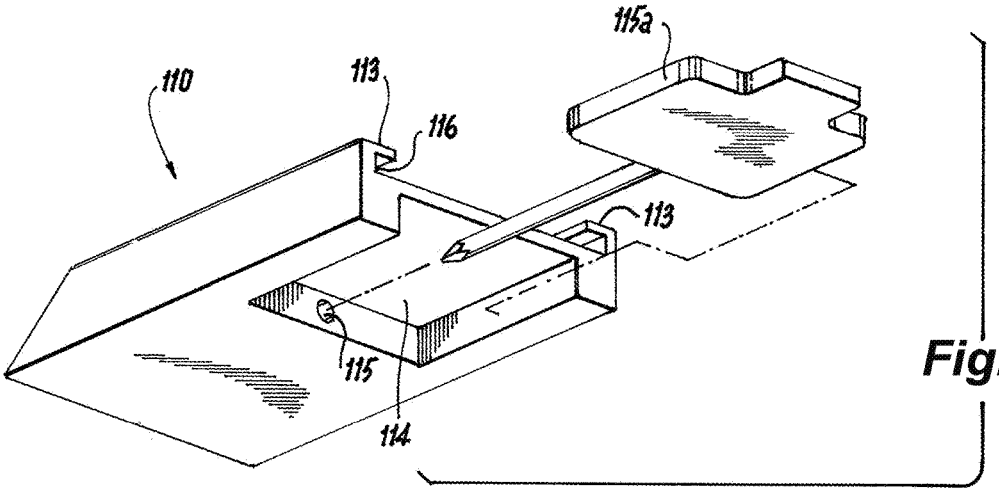
FIG. 3 is a bottom perspective view of the base member of a surf wax handling assembly built in accordance with a fin key embodiment of the present invention shown with a fin key.
Figure 4:
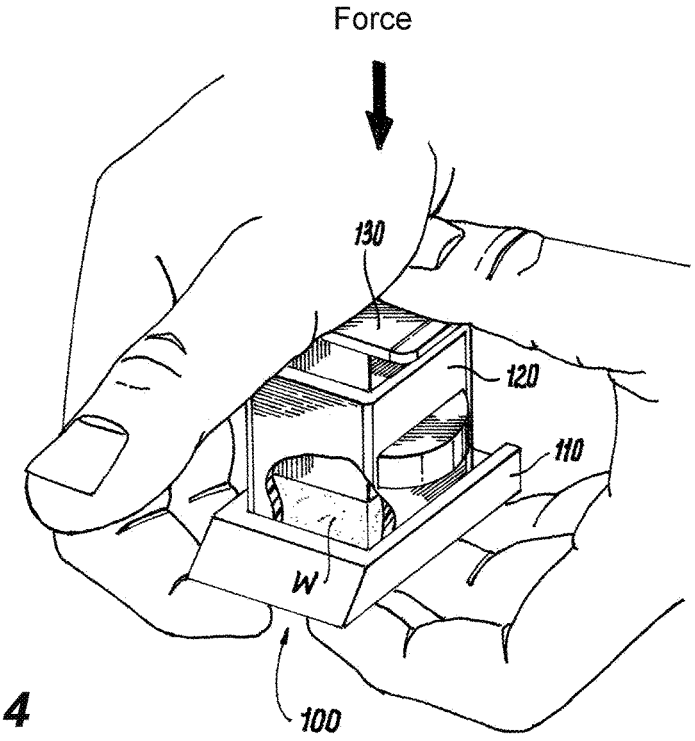
FIG. 4 is a perspective view of a surf wax handling assembly built in accordance with a fin key embodiment of the present invention shown with a portion of the receptacle member cut away, and shown with the receptacle member in a pressing position with the press member being pushed into the receptacle member to press wax.
Figure 5:
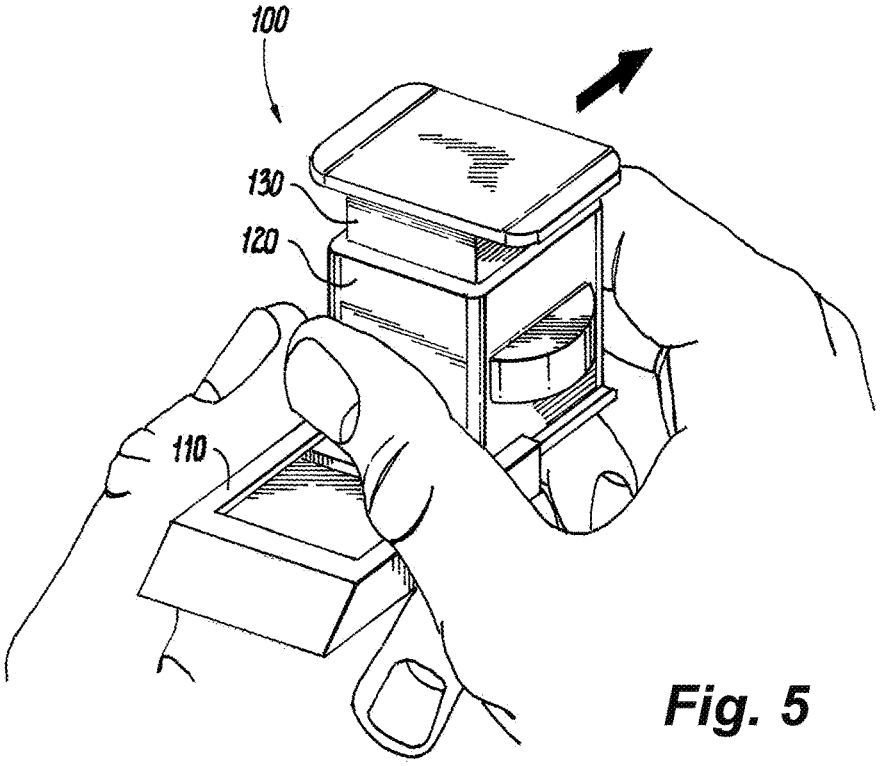
FIG. 5 is a perspective view of a surf wax handling assembly built in accordance with a fin key embodiment of the present invention shown with the receptacle member in a proximal position being slid off the base member.

The receptacle member 120 is defined by a rigid rectangular box having an open top and an open bottom disposed between a hollow interior. Extending outwardly around the entire receptacle member 120, adjacent to the open bottom of the receptacle member 120, is a securing ridge 121. The securing ridge 121 is sized to correspond to the securing recesses 116 on the base member 110 so as to allow the securing ridge 121 on any side of the receptacle member 120 to be inserted into and slide in one of the securing recesses 116. Other than the securing ridge 121, the receptacle member 120 is sized to be fit in planar surface 112, between two opposing raised side edges 113, such that when the receptacle member 120 is aligned with the base member 110 as shown in FIGS. 2 and 5, the securing ridge 121 on opposing sides of the receptacle member 120 are able to be simultaneously slid into the opposing securing recesses 116, thereby slidably securing the receptacle member 120 to the base member 110. When secured to the base member 110, the receptacle member 120 can be slid between a distal position in which it is adjacent to the scraper side 111, as shown in FIGS. 1 and 4, and a proximal position where it is located when being inserted or removed from the base member 110, as shown in FIG. 5. When in the distal position, the planar surface 112 serves as a rigid surface that encloses the open bottom of the receptacle member 120 and against which material in the hollow portion of the receptacle member 120 can be pressed.

Figure 6:
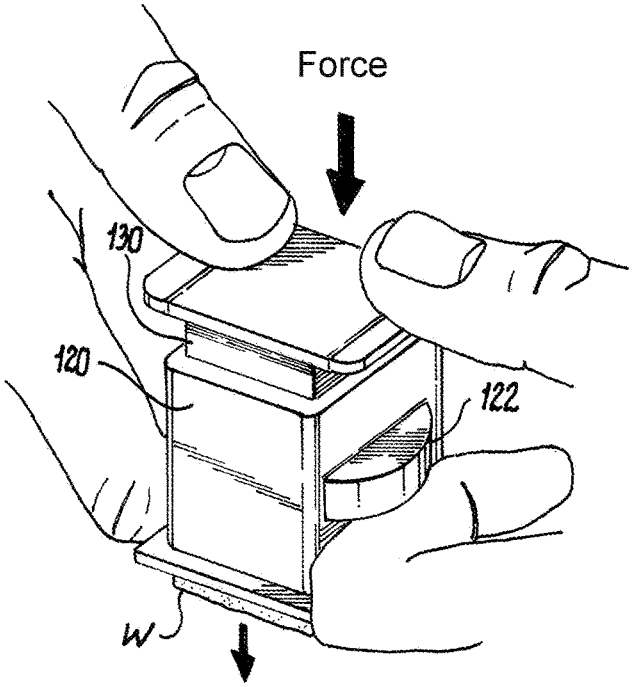
FIG. 6 is a perspective view of the press member and the receptacle member of a surf wax handling assembly of the present invention shown with the press member being pushed into the receptacle member to push wax out of the bottom opening of the receptacle member.

The press member 130 is defined by a rigid block sized to slidably engage with the receptacle member 120 in a manner that allows it to be inserted into the open top and slid through the hollow portion of the receptacle member 120 and move any material present into the hollow portion away from the open top. In this regard, when the receptacle member 120 is in the distal position, material (such as pieces of wax W) that is positioned in the hollow portion, on top of the planar surface 112, can be pressed together by inserting the press member 130 into the open top and down towards the planar surface 112. In this regard, a plurality of wax pieces can be pressed into a single, large wax block that can be reused. After such wax is pressed together into the bottom of the receptacle member 120, the receptacle member 120 may be slid off the base member 110, as shown in FIG. 5. Once the receptacle member 120 is removed from the base member 110, the press member 130 can be pushed further down through the receptacle member 120 so as to expel the wax W from the receptacle member 120, as shown in FIG. 6. It is recognized that the wax W may either be expelled completely from the receptacle member 120 so as to be reused as a new wax block, or it may be pushed only partially out of the receptacle member 120 so as to expose only a portion of the wax block such that it may be applied to a surf board using the receptacle member 120 as an applicator to grip the block of wax W.

In one embodiment, the receptacle member 120 includes opposing handle members 122 that extend laterally from the two opposing sides of the receptacle member 120. It is contemplated that the opposing handle members 122 provide a place for a user to hold with their fingers for leverage while sliding the press member 130 through the hollow portion of the receptacle member 120.

In one embodiment, the base member 110 includes a key chain 217.

Referring now to FIGS. 7, 8, 9, and 10, a collection embodiment of a surf wax handling assembly 200 for collecting scraped wax W and reusing wax pieces is shown also having base member 210, a hollow receptacle member 220, and a press member 230. In the collection embodiment, the hollow receptacle member 220 and press member 230 are substantially similar in form and operation as in the fin key embodiment.

The press member 230 may, however, include a wide lip 231 to prevent it from extending too far into the receptacle member 220. In one embodiment, the surf wax handling assembly may include a wax comb formed by a slanted side surface 232 on the lip 231 at the top edge of the press member 230 as shown in FIG. 7. In addition, the handle members 222 may extend along the entire side of the receptacle member 220.

In the collection embodiment, extending outwardly around the entire receptacle member 220, adjacent to the open bottom of the receptacle member 220, is a securing ridge 221. The securing ridge 221 is sized to correspond to the securing recesses 216 on the base member 210 so as to allow the securing ridge 221 on any side of the receptacle member 220 to be inserted into and slide in one of the securing recesses 216.

The base member 210 in the collection embodiment does include a slanted scraper 211 at one end and a top portion that includes a planar surface 212 disposed between two opposing raised side edges 213 with securing recesses 216 so as to allow the receptacle member 220 to slidably engage therewith as in the fin key embodiment. But in the collection embodiment, the side edges 213 extend horizontally further along the same plane as the top portion, above the scraper 211, forming an interior channel 218 that leads up from the bottom edge of the scraper 211 to the planar surface 212. Since the side edges 213 (and accompanying securing recesses 216) extend out and above the scraper 211, the receptacle member 220 can be moved to a distal position above the channel 218, as shown in FIG. 8, so that when the receptacle member 220 is in the distal position, wax scrapings from the scraper 211 are directed from the scraper 211, up the channel 218, and into the receptacle member 220. The receptacle member 220 can also be slid to a proximal position, as with the fin key embodiment, where it is located when being inserted or removed from the base member 210. The receptacle member 220 can also be slid to a pressing position, as illustrated in FIG. 9, that is somewhere between the distal position and the proximal position, far enough away from the distal position that the open bottom of the receptacle member 220 is not over any portion of the channel 218, to allow the planar surface 212 to serve as a rigid surface that encloses the open bottom of the receptacle member 220 and upon which material in the hollow portion of the receptacle member 220 may be pressed against.

In one embodiment, the base member 210 additionally includes opposing base handles 219 that extend laterally from the two opposing sides of the base member 210. It is contemplated that the base handles 219 provide a place for a user to place their fingers on for leverage when sliding the receptacle member 220 along the base member 210.

In one embodiment, the surf wax handling assembly may include a bottle opener built into any surface of the press member or the base member.

In one embodiment, the surf wax handling assembly may include a flip out pocketknife.

In one embodiment, the surf wax handling assembly may include a leash string integral therewith for coupling the assembly with a surfboard.

In one embodiment, the surf wax handling assembly may include slots for fin screws to be inserted.

It will be understood that many additional changes in the details, materials, steps and arrangement of parts, which have been herein described and illustrated to explain the nature of the invention, may be made by those skilled in the art within the principle and scope of the invention as expressed in any appended claims.

What is claimed is:

1. A surf wax handling assembly, comprising:

a base member defined by an elongated, rigid body having a slanted scraper at one end and a top portion that includes a pressing surface disposed between two opposing raised side edges;

a receptacle member defined by a rigid container having an open top, an open bottom, and a hollow interior, wherein said receptacle member is configured to selectively engage with the top portion of said base member such that the pressing surface of the base member encloses the open bottom of the receptacle member; and a press member configured to slide into the open top of the receptacle member and through the hollow interior of the receptacle member so as to move material present into the hollow portion away from the open top.

2. The surf wax handling assembly of claim 1, wherein said press member is defined by a rigid mass.

3. The surf wax handling assembly of claim 2, wherein said receptacle member is defined by a rigid rectangular box.

4. The surf wax handling assembly of claim 1, wherein said opposing raised side edges each include a securing recess that extends along the length of the respective side edge.

5. The surf wax handling assembly of claim 4, wherein said receptacle member is configured to selectively engage with the top portion of said base member through a securing ridge that is adjacent to the open bottom of the receptacle member on at least one side of the receptacle member.

6. The surf wax handling assembly of claim 5, wherein said securing ridge extends around the entire receptacle member.

7. The surf wax handling assembly of claim 1, wherein said receptacle member includes opposing handle members that extend laterally from the two opposing sides.

8. The surf wax handling assembly of claim 1, wherein said base member is configured to hold a fin key.

9. The surf wax handling assembly of claim 8, wherein said base member is configured to hold a fin key in a bottom portion that includes a depressed surface and a fin key slot.

10. The surf wax handling assembly of claim 1, wherein said base member additionally includes opposing base handles that extend laterally from the two opposing sides of the base member.

11. The surf wax handling assembly of claim 1, wherein said opposing raised side edges extend horizontally above the scraper further along the same plane as the top portion thereby forming an interior channel that leads up from an edge of the scraper to the planar surface.

12. The surf wax handling assembly of claim 1, wherein said press member is configured to be blocked from extending too far into the receptacle member through a wide lip.

13. A surf wax handling assembly, comprising:

a base member defined by an elongated, rigid body having a slanted scraper at one end and a top portion that includes a pressing surface disposed between two opposing raised side edges;

a receptacle member defined by a rigid container having an open top, an open bottom, and a hollow interior, wherein said receptacle member is configured to selectively engage with the top portion of said base member such that the pressing surface of the base member encloses the open bottom of the receptacle member;

a press member configured to slide into the open top of the receptacle member and through the hollow interior of the receptacle member so as to move material present into the hollow portion away from the open top;

wherein said opposing raised side edges each include a securing recess that extends along the length of the respective side edge and said receptacle member is configured to selectively engage with the top portion of said base member through a securing ridge that is adjacent to the open bottom of the receptacle member on at least one side of the receptacle member; and wherein said opposing raised side edges extend horizontally above the scraper further along the same plane as the top portion thereby forming an interior channel that leads up from an edge of the scraper to the planar surface.

14. The surf wax handling assembly of claim 13, wherein said base member additionally includes opposing base handles that extend laterally from the two opposing sides of the base member.

15. The surf wax handling assembly of claim 13, wherein said press member is configured to be blocked from extending too far into the receptacle member through a wide lip.

16. The surf wax handling assembly of claim 13, wherein said receptacle member includes opposing handle members that extend laterally from the two opposing sides.

17. A surf wax handling assembly, comprising:

a base member defined by an elongated, rigid body having a slanted scraper at one end and a top portion that includes a pressing surface disposed between two opposing raised side edges;

a receptacle member defined by a rigid container having an open top, an open bottom, and a hollow interior, wherein said receptacle member is configured to selectively engage with the top portion of said base member such that the pressing surface of the base member encloses the open bottom of the receptacle member;

a press member configured to slide into the open top of the receptacle member and through the hollow interior of the receptacle member so as to move material present into the hollow portion away from the open top;

wherein said opposing raised side edges each include a securing recess that extends along the length of the respective side edge and said receptacle member is configured to selectively engage with the top portion of said base member through a securing ridge that is adjacent to the open bottom of the receptacle member on at least one side of the receptacle member; and wherein said base member is configured to hold a fin key in a bottom portion that includes a depressed surface and a fin key slot.

18. The surf wax handling assembly of claim 17 wherein said base member additionally includes opposing base handles that extend laterally from the two opposing sides of the base member.

19. The surf wax handling assembly of claim 17, wherein the press member is configured to be blocked from extending too far into the receptacle member through a wide lip.

20. The surf wax handling assembly of claim 17, wherein said receptacle member includes opposing handle members that extend laterally from the two opposing sides.

* * * * *